US005759230A

United States Patent [19]

Chow et al.

[11] Patent Number: 5,759,230

[45] Date of Patent: Jun. 2, 1998

[54] NANOSTRUCTURED METALLIC POWDERS AND FILMS VIA AN ALCOHOLIC SOLVENT PROCESS

[75] Inventors: Gan-Moog Chow, Bowie, Md.; Paul E. Schoen; Lynn K. Kurihara, both of Alexandria, Va.

[73] Assignee: The United States of America as represented by the Secretary of the Navy, Washington, D.C.

[21] Appl. No.: 565,488

[22] Filed: Nov. 30, 1995

[51] Int. Cl.[6] ..... B22F 9/24

[52] U.S. Cl. ..... 75/362; 75/371; 75/373; 75/374; 427/229

[58] Field of Search ..... 75/362, 370, 371, 75/373, 374; 427/229, 383.1

[56] References Cited

U.S. PATENT DOCUMENTS

| | | | |
|---|---|---|---|
| 4,539,041 | 9/1985 | Figlarz et al. | 75/371 |
| 4,615,736 | 10/1986 | Armor et al. | 75/371 |
| 4,913,938 | 4/1990 | Kawakami et al. | 427/383.1 |
| 5,338,714 | 8/1994 | Rousset et al. | 75/362 |
| 5,470,373 | 11/1995 | Edelstein et al. | 75/255 |
| 5,520,717 | 5/1996 | Miller et al. | 75/362 |
| 5,525,162 | 6/1996 | Horn et al. | 136/201 |

FOREIGN PATENT DOCUMENTS

| | | | |
|---|---|---|---|
| 63-149383 | 6/1988 | Japan | 75/362 |
| 2236117 | 3/1991 | United Kingdom | 75/362 |

OTHER PUBLICATIONS

*Webster's New International Dictionary of the English Language*, 2nd Edition, G&C Merriam Company, 1939, p. 2093.

*Encyclopedia of Polymer Science and Engineering*, vol. 9, John Wiley & Sons, 1987, pp. 580–585.

Van Wylen, G., et al., *Fundamentals of Classical Thermodynamics*, 2nd Edition, 1978, pp. 38–39.

Deschamps et al., *J. Mater. Chem.*, 1992 vol. 2, 1213–1214.

Flevet et al., *J. Mater. Chem.*, 1993, 3(6), 627–632.

Chow et al., Nanocrystalline Cobalt–Copper Particles via a Polyol Process, *Abstract*, presented at the 1994 MRS Spring Meeting.

*Primary Examiner*—George Wyszomierski

*Attorney, Agent, or Firm*—Thomas E. McDonnell; Barry A. Edelberg

[57] ABSTRACT

Nanostructured metal powders and films are made by dissolving or wetting a metal precursor in an alcoholic solvent. The resulting mixture is then heated to reduce the metal precursor to a metal precipitate. The precipitated metal may be isolated, for example, by filtration.

16 Claims, 2 Drawing Sheets

NANOSTRUCTURED METALLIC POWDERS AND FILMS VIA AN ALCOHOLIC SOLVENT PROCESS

BACKGROUND OF THE INVENTION

1. Field of the Invention

The present invention relates generally to the synthesis of metal powders and films, and more specifically, to the synthesis of nanostructured metal powders and films.

2. Description of the Background Art

Nanostructured powders and films (with particle diameters of about 1–100 nm) have many potential electronic, magnetic, and structural applications. Among the various preparative techniques used, chemical routes offer the advantages of molecular or atomic level control and efficient scale-up for processing and production. Others in the art have prepared micron and submicron-size metallic powders of Co, Cu, Ni, Pb and Ag using the polyol method. These particles consisted of single elements. Depending on the type of metallic precursors used in the reaction, additional reducing and nucleating agents were often used. The presence of the additional nucleating and reducing agents during the reaction may result in undesirable and trapped impurities, particularly non-metallic impurities.

These prior procedures, however, have been unable to obtain nanostructured powders having a mean size of about 1–100 nm diameter. Nor have these prior procedures been useful in producing nanostructured powders of metal composites or alloys. Also, these prior procedures have not been used to produce metal films.

Additionally, the prior procedures have only been used to produce powders of metals that are not refractory. A concern existed that a precursor containing refractory metal atoms would react with the polyol to form a stable oxide, thus preventing complete reduction of the precursor to the elemental metal.

SUMMARY OF THE INVENTION

Accordingly, it is an object of this invention to form nanostructured metal products It is another object of the present invention to form nanostructured metal films.

It is a further object of the present invention to form nanostructured powders and films of metal alloys and metal/ceramic composites.

It is yet another object of the present invention to form nanostructured powders and films of refractory metals.

It is yet further object of the present invention to form nanostructured powders and films of metals, metal alloys, and metal/ceramic composites without the need to use a nucleating agent.

These and additional objects of the invention are accomplished by reacting a metal precursor, or a mixture of metal precursors, with an alcoholic solvent for a time sufficient to provide nanostructured powders or films, at a temperature where the metal precursor is soluble in the alcoholic solvent. The precursor of the metal desired to be formed, reaction temperature, and reaction time, are selected to provide nanostructured materials. The precursor used, the reaction time, and the reaction temperature that provide nanostructured materials are inter-related and are additionally dependant upon the metal desired to be formed.

BRIEF DESCRIPTION OF THE DRAWINGS

A more complete appreciation of the invention will be readily obtained by reference to the following Description of the Preferred Embodiments and the accompanying drawings, wherein.

DESCRIPTION OF THE PREFERRED EMBODIMENTS

Figure 1:
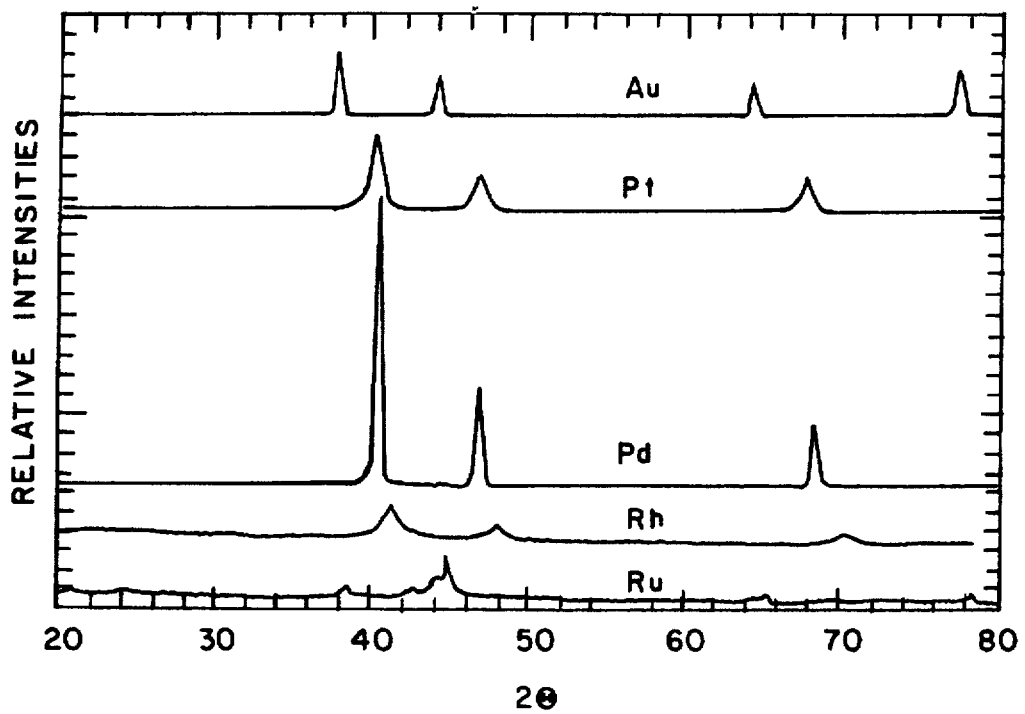
FIG. 1 is the x-ray diffraction spectra of films of Au, Pt, Pd, Rh, and Ru deposited according to the method of the present invention.

In practicing the present invention, a metal precursor is mixed with an alcoholic solvent. As defined in the present specification and claims, the term "alcoholic solvent" includes alcohols and polyols. Any alcoholic solvent that is liquid and dissolves the metal precursor or precursors, or allows the metal precursor or precursors to react, at the reaction temperature may be used. For example, the polyols described by Figlarz et al., in U.S. Pat. No. 4,539,041, the entirety of which is incorporated herein by reference for all purposes, may be used. Specifically, Figlarz et al. recite the use of aliphatic glycols and the corresponding glycol polyesters, such as alkylene glycol having up to six carbon atoms in the main chain, ethylene glycol, a propylene glycol, a butanediol, a pentanediol and hexanediol and polyalkylene glycols derived from those alkylene glycols. Alcoholic solvents typically used in the method of the present invention include ethylene glycol, diethylene glycol, triethylene glycol, tetraethylene glycol, propylene glycol and butanediols. If desired, mixtures of alcohols and polyols may be used.

The metal precursor or precursors are then mixed with the alcoholic solvent. At the time of mixing, this alcoholic solvent may be either heated or unheated. Then, the resulting mixture is reacted at temperatures sufficiently high to dissolve, or allow the reaction of, the metal precursor or precursors and form precipitates of the desired metal. Usually, refluxing temperatures are used. Generally, the mixture is reacted at about 85° C.–350° C. Typically, the reaction mixture is reacted at about 120° C.–200° C. The preferred temperature depends on the reaction system used. After the desired precipitates form, the reaction mixture may be cooled either naturally (e.g., air cooling) or quenched (forced cooling). Because quenching provides greater control over the reaction time, it is preferred to air cooling. For quenching to be useful in the deposition of a conductive metal film upon a substrate, however, the substrate must and the film/substrate interface must be able to withstand rapid thermal changes. If the substrate an/or film/substrate interface cannot withstand these rapid thermal changes, then air cooling should be used.

The method of the present invention may be used to form particles of various metals and alloys or composites thereof. For example, nanostructured films or powders of Ti, V, Cr, Mn, Fe, Co, Ni, Cu, Nb, Mo, Ru, Rh, Pd, Ag, In, Sn, Ta, W, Re, Os, Ir, Pt, Au, or alloys or composites containing these metals, may be made according to the present invention. As explained below, the precursor form for the metal will depend upon the metal itself. Generally, the precursor may be any metal-containing compound that, under the reaction conditions, is reduced to the elemental metal and by-products that are soluble in the reaction mixture. Typical precursors include metal acetates and hydrates thereof, metal chlorides and hydrates thereof, metal nitrates, metal oxides, metal oxalates, metal hydroxides, and acids including the desired metal as part of an oxyanion (e.g., tungstic acid) and salts of such acids (e.g., sodium tungstate and potassium hexachlorplatinate). The best precursors to use for the formation of nanostructured powders and films including any specific metal will depend upon the metal selected. Typically, to provide nanostructured materials, the precursors used in the present invention should be substantially soluble in the reaction mixture.

The concentration of the precursor in the reaction mixture seemed to influence crystallite size in only some cases over the concentration ranges explored in the examples discussed below. Where this influence was noted, smaller precursor concentration tended to provide smaller crystallites and particles. If the concentration of the precursor is too small, few, if any precipitates will form. Too high of a concentration of the precursor may result in crystallites that are larger than sub-micron size. Additionally, sufficient alcoholic solvent must be present to completely reduce essentially all metal precursors in the reaction mixture. Otherwise, the unreacted precursor may prevent the formation of a pure or essentially pure nanostructured metal material. Typically, the precursors are used in concentrations of about 0.001–0.80M, more often about 0.05–0.50M, and most often about 0.1–0.25M.

Generally, crystallite and particle size increase with increasing reaction time. In the present invention, typical reaction times, at refluxing temperatures, extend from about 30 minutes to about 5 hours, and more often from about 1 hour to about 3 hours. With increasing reaction temperature, the crystallite size generally increases.

In one embodiment, the present invention provides nanostructured powders of refractory metals and their alloys. Refractory metals include W, Ti, Mo, Re, and Ta. If oxides of refractory metals are chemically stable under the reaction conditions employed, they cannot be reduced to form nanostructured metals or films. Therefore, the precursors of these refractory metals should be chosen to avoid the formation of such stable oxides or their stable intermediates. Generally, the precursors of refractory metals should be salts or acids, rather than oxides or hydroxides, including the desired refractory metal or metals. Acids and salts including the oxyanion of the desired refractory metal or metals, however, may be preferred.

The method of the present invention can produce nanostructured powders and films in the absence of a nucleating agent or catalyst. The resulting nanostructured films can thus be free or essentially free of impurities that would deleteriously alter their properties. If desired, surfactants and/or dispersants may be added to the reaction mixture to avoid the agglomeration of nanoparticles. If a highly pure product is desired, these surfactants and dispersants should be essentially free of insoluble materials, or capable of being burnt out of the final product. Where a surfactant is used, the best choice of surfactant will depend upon the desired metal. Steric stabilization, using a nonionic surfactant (e.g., a high temperature polymeric surfactant), is preferred, since ionic surfactants may undesirably alter the pH of the reaction system during reduction of the metal precursor. If desired, however, a mixture of ionic and nonionic surfactants can be used.

The pH may influence the method of the present invention. For examples, changing the pH during the reaction may be used to alter the solubility of the reaction product in the reaction mixture. By altering the solubility of the smallest crystallites during the reaction, the average size of the crystallites obtained may be controlled. If a constant pH is desired throughout the reaction, the reaction mixture may be modified to include a buffer.

During the reaction, the reaction mixture may, but need not, be stirred or otherwise agitated, for example by sonication. The effects of stirring during the reaction depend upon the metal to be formed, the energy added during stirring, and the form of the final product (i.e., powder or film). For example, stirring during the production of a magnetic materials would most likely increase agglomeration (here, the use of a surfactant would be beneficial), while stirring during the formation of a films would most likely not significantly affect the nanostructure of the film. Stirring during the formation of films, however, will probably influence the porosity of the formed films and thus may be useful in sensor fabrication.

To produce a nanostructured film, the substrate upon which the film is to be provided is contacted with the reaction mixture during the reaction. Unlike electrochemical deposition methods, which require an electrically conductive substrate, the present invention can provide thin, adherent (as determined by the adhesive tape test) nanostructured films on any surface, including electrically insulating substrates. Also, unlike aqueous electroless plating methods, the process of the present invention can produce thin, adherent nanostructured metal films on surfaces that should not be processed in aqueous environments.

In particular, the process of the present invention has been used to deposit nanocrystalline metallic films on substrates glasses including borosilicates, such as Pyrex™, glasses that are essentially free of borosilicates, polyimides such as Kapton™, perfluorinated polymers such as Teflon™ (poly [tetrafluoroethylene]), aluminum nitride, carbon, and alumina. The method of the present invention deposits nanocrystalline metallic films on both two dimensional substrates (flat surfaces) and three-dimensional substrates (e.g., fiber and preforms).

The method of the present invention may also be used to produce nanostructured composite metal films and powders. As defined herein, a composite metal film includes at least one metal first component and at least one other component that is intentionally included in amounts that significantly enhance the desirable properties of the film or powder. The other component, which is also nanostructured, is usually, but not necessarily, a metal. Where the other component is a metal, the metal may be any metal, not just those metals that could be deposited as a pure films according to the method of the present invention. Throught the present specification and claims, the term "complex substance" is defined as an composite or an alloy that includes at least two different components. Throughout the present specification and claims, the term "alloy" applies to intermetallic compounds and solid solutions of two or more metals. The term "composite" applies to phase-separated mixtures of a metal with at least one other component. Where the other component of the final product is a chemically stable ceramic, the present invention provides a nanostructured metal/ceramic composite. Generally, a metal/ceramic composite includes at least 50 volume percent metal, in the form of a single phase material or an alloy. Throughout the present specification and claims, the term "composite" includes alloys, and metal/ceramic composites.

To produce the complex substances, a precursor(s) for the at least one metal component and a precursors for the other component or components are atomically mixed in the reaction mixture before heating the mixture to the reaction or refluxing temperature. Otherwise, the process proceeds as described above in the case of powders and films, respectively.

In producing composite substances according to the present invention, the initial molar ratios of the components to each other may not be reflected in the final product. Additionally, the ability of precursors for the components to atomically mix in the reaction solution does not assure that the components will form a composite substance final product. For this reason, the correct starting ratios of the precursors each component for any composite substance must be determined empirically. The relative reduction potentials of each component can provide some guidance in making this empirical determination.

Having described the invention, the following examples are given to illustrate specific applications of the invention including the best mode now known to perform the invention. These specific examples are not intended to limit the scope of the invention described in this application.

EXAMPLES

The general procedure for the synthesis of different metallic powders and films involved suspending the corresponding metal precursors in ethylene glycol or tetraethylene glycol and subsequently bringing the resulting mixture to refluxing temperature (generally between 120° to 200° C.) for 1–3 hr. During this reaction time, the metallic moieties precipitated out of the mixture. The metal-glycol mixture was cooled to room temperature, filtered and the collected precipitate was dried in air. For film deposition, substrates were immersed in the reaction mixture. The substrates were used in the "as-received" conditions, without preparative surface treatment. The reaction times cited in this study were taken from when heat was initially applied to the solution mixture. The reaction temperature was measured using a thermocouple inserted in a glass port which was submerged in the solution. The crystal structure of the powders and films were studied using X-ray diffraction (XRD). Line broadening of XRD peaks was used to estimate the average crystallite size. The morphology was investigated using scanning electron microscopy (SEM) and transmission electron microscopy (TEM) (accelerating voltage of 300 kV).

Figure 2:
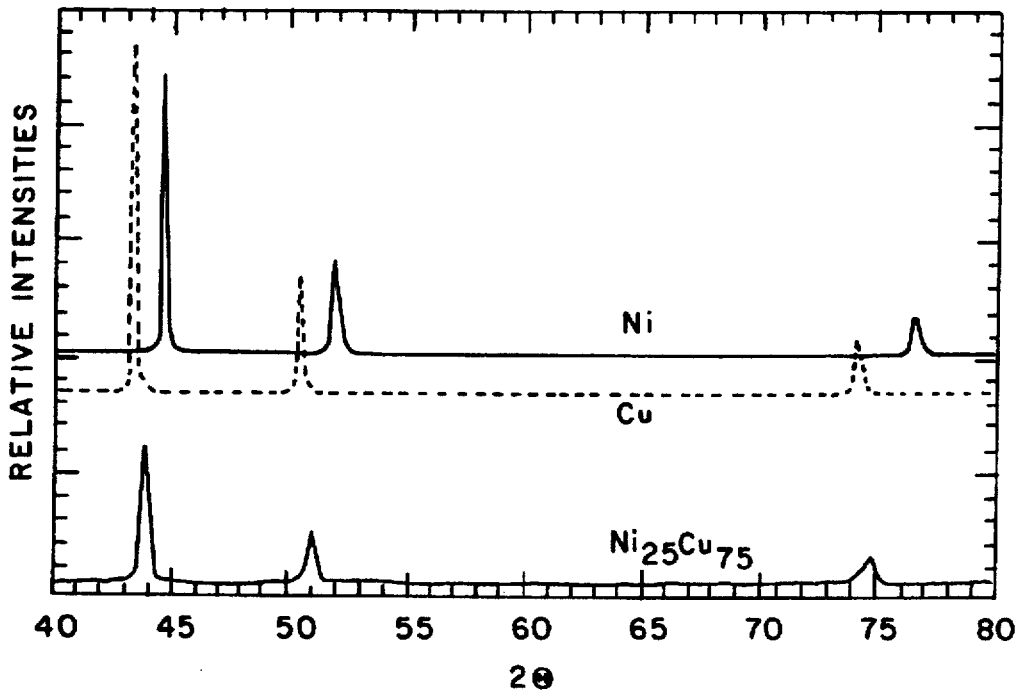
FIG. 2. is the x-ray diffraction spectra of powsers of Ni, Cu, and $Ni_{0.25}Ni_{0.75}$ deposited according to the method of the present invention.

Table I shows processing parameters and results of the alcoholic solvent method used to prepare metallic powders and films. Examples of XRD results for several metallic films are shown in FIG. 1. FIG. 2 shows comparative XRD spectra of the as-synthesized powders of Ni, Cu and an alloy of $Ni_{25}Cu_{75}$. For this system of Ni and Cu, diffraction peaks of $Ni_{25}Cu_{75}$ were found to obey Vegard's law and the formation of a solid solution was confirmed. These results indicate that alloys can be synthesized from solution with atomic level mixing. For immiscible metals such as the $Cu_xCo_{100-x}$ system ($4 \leqq x \leqq 49$ at. %), it was found that a composite was formed.

Figure 3:
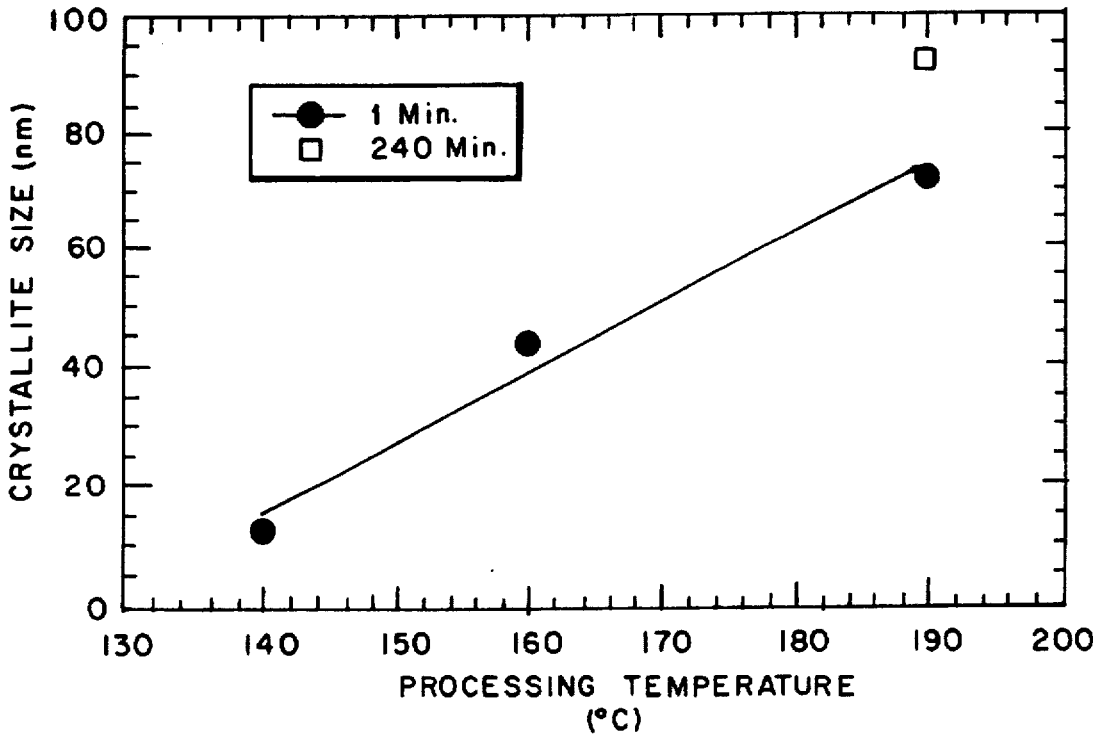
FIG. 3. is a graph showing the effects of increasing processing temperature and time on the crystallite size of Cu powders deposited according to the method of the present invention.

The effects of processing temperature and reaction time on crystallite size were studied using the single element system Cu. Crystallite sizes, as expected, increased both with temperature and time, ranging from 10 to 80 nanometers (FIG. 3). Others have prepared copper particles with diameters within the 0.46–1.82 micron range by reducing CuO in a polyol/sorbitol mixture. They controlled the mean particle size by adding NaOH, which was believed to enhance the rate of reduction of the dissolved Cu species. The particle size of the copper particles without the addition of NaOH was found to be 1.32–4.23 micron range. In SEM and TEM micrographs of a nanostructured W film made according the experimental above procedure, the nanoscale particles of the film exhibited a crystallite size of about 12 nm (see Table I).

TABLE I

Synthesis parameters and products of the polyol reactions (the range of crystallite size is given when it is concentration dependent)

| Material | Precursors | Concentration Range used (mol/L) | Average Crystallite Size (nm) of Powder | Average Crystallite Size (nm) of Coating* | reaction time (hr) |
|---|---|---|---|---|---|
| Fe | iron (II) acetate | 0.01–0.20 | 20 | | 2 |
| Co | cobalt (II) acetate tetrahydrate | 0.05–0.20 | 12.1 | 15(K)<br>14(P) | 2 |
| | cobalt (II) chloride hexahydrate | | 14 | 23(T) | |
| Ni | nickel (II) acetate tetrahydrate | 0.02–0.20 | 20 | 9(K)<br>30(T)<br>15(P) | 1<br>1 |
| Cu | copper (II) acetate tetrahydrate | 0.02–0.25 | 10–80 | 12(AIN)<br>43(K) | 2 |
| Ru | ruthenium (III) chloride | 0.021 | 5 | | 1 |
| Rh | rhodium (III) chloride | 0.01 | | 9(P) | 1 |
| Pd | palladium (II) chloride | 0.02–0.15 | 10 | 18(K)<br>22(P) | 1 |
| Ag | silver nitrate | 0.05–0.20 | 40 | 34(T)<br>43(K)<br>50(P) | 1 |
| Sn | tin (II) oxide | 0.01–0.03 | 36 | | 2 |
| Re | rhenium (III) chloride | 0.02 | | 14(P) | 1 |
| W | tungstic acid | 0.012–0.20 | 8 | 12(P) | 3 |
| | sodium tungstate | 0.03 | 10 | | |

TABLE I-continued

Synthesis parameters and products of the polyol reactions (the range of crystallite size is given when it is concentration dependent)

| Material | Precursors | Concentration Range used (mol/L) | Average Crystallite Size (nm) of Powder | Average Crystallite Size (nm) of Coating* | reaction time (hr) |
|---|---|---|---|---|---|
| Pt | potassium hexachlorplatinate (IV) | 0.01–0.20 | 2 | 10(K) 12(T) 14(GF) 15(AF) (SF) | 1 |
| Au | gold (III) chloride | 0.01–0.20 | 28 | 32(P) | 2 |
| Fe—Cu | iron (II) acetate | 0.016–0.16 | 27–47 | | 2 |
| | copper (II) acetate tetrahydrate | 0.018–0.14 | | | |
| Co—Cu | cobalt (II) acetate tetrahydrate | 0.01–0.20 | 17–35 | | 2 |
| | copper (II) acetate tetrahydrate | | | | |
| Ni—Cu | nickel (II) acetate tetrahydrate | 0.0321 | 8 | | 1 |
| | copper (II) acetate tetrahydrate | 0.0963 | | | |

*keys: K = Kapton, P = Pyrex, T = Teflon, G = graphite, A = alumina, S = sapphire, F = Fiber The adhesion of the deposited films on different substrates was also qualitatively examined using adhesive tape peel test. They were found to adhere to the substrates and were not removed by the tape.

Obviously, many modifications and variations of the present invention are possible in light of the above teachings. It is therefore to be understood that, within the scope of the appended claims, the invention may be practiced otherwise than as specifically described.

What is claimed is:

1. A method of forming a nanocrystalline metallic powder, comprising the steps of:

mixing a precursor of a refractory metal with an alcoholic solvent to form a reaction mixture, said precursor being selected from the group consisting of a metal salt, a hydrate of a metal salt, an acid including said refractory metal as part of an oxyanion, a salt of said acid, and mixtures thereof;

refluxing said reaction mixture so that said alcoholic solvent reduces said precursor to said refractory metal, over a time selected to produce particles of said refractory metal having a mean diameter size of about 100 nm or less.

2. The method of claim 1, wherein said mixing step and said reacting step are performed in such a manner that said particles of said refractory metal are essentially free of non-metallic impurities.

3. The method of claim 2, wherein said mixing step and said reacting step are performed in such a manner that said particles of said refractory metal are essentially pure.

4. The method of claim 1, wherein said metal precursor is a metal acetate, a metal chloride, a metal nitrate, metal acetate hydrate, a metal chloride hydrate, or a metal nitride hydrate.

5. The method of claim 1, wherein said refractory metal is selected from the group consisting of W, Ti, Mo, Re, and Ta.

6. The method of claim 1, wherein said reaction mixture is reacted at a temperature at which said metal precursor is soluble in said alcoholic solvent.

7. The method of claim 1, wherein said reaction mixture is reacted for about 30 minutes–5 hours.

8. The method of claim 7, wherein said reaction mixture is reacted for about 1–3 hours.

9. The method of claim 1, wherein said precursor is present in said reaction mixture at a concentration of about 0.001–0.80M.

10. A method of forming a nanocrystalline metallic film, comprising the steps of:

mixing a precursor of a metal selected from the group consisting of Ti, V, Cr, Mn, Fe, Co, Ni, Nb, Mo, Ru, Rh, Sn, Ta, W, and mixtures thereof with an alcoholic solvent to form a reaction mixture, said precursor being selected from the group consisting of a metal salt, a hydrate of a metal salt, an acid including said refractory metal as part of an oxyanion, a salt of said acid, and mixtures thereof;

physically contacting said reaction mixture with a substrate surface that is essentially free of borosilicates;

refluxing said reaction mixture so that said alcoholic solvent reduces said metal precursor, while said reaction mixture is in contact with said substrate surface, for a time selected to produce an adherent metal film on said substrate surface, said film having particles of said metal with a mean diameter size of about 100 nm or less.

11. The method of claim 10, wherein said metal precursor is a metal acetate, a metal chloride, a metal nitrate, a metal acetate hydrate, a metal chloride hydrate, or a metal nitride hydrate.

12. The method of claim 10, wherein said metal is a refractory metal.

13. The method of claim 12, wherein said refractory metal is selected from the group consisting of W, Ti, Mo, Re, Ta, and alloys thereof.

14. The method of claim 10, wherein said mixing step and said reacting step are performed in such a manner that said particles of said refractory metal are essentially free of non-metallic impurities.

15. A method of forming a nanocrystalline complex substance comprising at least 50 volume percent of first component selected from the group consisting of an elemental refractory metal or an alloy thereof, said method comprising the steps of:

atomically mixing, in an alcoholic solvent, a first precursor for at least one elemental refractory metal with a second precursor for at least one second component, or with said second component, to form a reaction mixture, said first precursor being selected from the group consisting of a metal salt, a hydrate of a metal salt, an acid including said elemental refractory metal as part of an oxyanion, a salt of said acid, and mixtures thereof;

refluxing said reaction mixture so that said alcoholic solvent reduces at least said first precursor to said elemental refractory metal, over a time selected to produce particles of said complex substance having a mean diameter size of about 100 nm or less.

16. The method of claim 15, wherein said second component is a metal or a ceramic.

* * * * *